US008274344B2

(12) United States Patent
Kato

(10) Patent No.: US 8,274,344 B2
(45) Date of Patent: Sep. 25, 2012

(54) ELECTROMAGNET FOR USE IN A RELAY

(75) Inventor: Yoshimasa Kato, Mie (JP)

(73) Assignee: Panasonic Electric Works Co., Ltd., Oaza-Kadoma, Kadoma-shi, Osaka (JP)

( * ) Notice: Subject to any disclaimer, the term of this patent is extended or adjusted under 35 U.S.C. 154(b) by 0 days.

(21) Appl. No.: 12/736,570

(22) PCT Filed: Apr. 10, 2009

(86) PCT No.: PCT/JP2009/057313

§ 371 (c)(1),
(2), (4) Date: Oct. 20, 2010

(87) PCT Pub. No.: WO2009/131015

PCT Pub. Date: Oct. 29, 2009

(65) Prior Publication Data

US 2011/0032061 A1 Feb. 10, 2011

(30) Foreign Application Priority Data

Apr. 24, 2008 (JP) ..... 2008-113583

(51) Int. Cl.
*H01H 51/22* (2006.01)
*H01F 27/02* (2006.01)

(52) U.S. Cl. ..... 335/85; 335/78; 335/80; 335/84; 335/86; 336/98; 336/208; 336/210

(58) Field of Classification Search ..... 335/78–85, 335/124, 128–131, 199, 202, 203, 278, 250, 335/279; 336/98, 208, 210
See application file for complete search history.

(56) References Cited

U.S. PATENT DOCUMENTS

| | | | | |
|---|---|---|---|---|
| 1,671,105 | A * | 5/1928 | Farrand et al. | 335/276 |
| 2,428,826 | A * | 10/1947 | Bauer | 242/159 |
| 3,278,876 | A * | 10/1966 | Coulombe et al. | 336/65 |
| 3,436,574 | A * | 4/1969 | Larsson | 310/194 |
| 4,109,221 | A * | 8/1978 | Pauli | 335/251 |
| 5,332,985 | A * | 7/1994 | Hendel | 335/78 |
| 5,519,369 | A * | 5/1996 | Hendel | 335/85 |
| 5,874,876 | A * | 2/1999 | Kobayashi et al. | 335/128 |
| 6,014,068 | A * | 1/2000 | Nobutoki et al. | 335/78 |
| 6,225,880 | B1 * | 5/2001 | Kern | 335/78 |
| 6,300,851 | B1 * | 10/2001 | Baur et al. | 335/128 |
| 6,359,537 | B1 * | 3/2002 | Ichikawa et al. | 335/85 |
| 6,611,189 | B2 * | 8/2003 | Sigl | 336/198 |

FOREIGN PATENT DOCUMENTS

| | | |
|---|---|---|
| JP | 4 57308 A | 2/1992 |
| JP | 515 9957 A | 6/1993 |

* cited by examiner

*Primary Examiner* — Mohamad Musleh
(74) *Attorney, Agent, or Firm* — Bacon & Thomas, PLLC

(57) ABSTRACT

An electromagnet for use in a relay having a coil bobbin with flange portions at both ends of a coil winding portion where a coil is wound and an iron core with a flange-like head portion at one end of a body portion, the coil bobbin being so fitted onto the iron core that the flange-like head portion and the other end of the body portion of the iron core respectively project out of each of openings formed at the flange portions of the coil bobbin. The iron core has at the other end an engageable portion to be engaged with an engaging portion formed on a grasping part of a coil winding chuck device. The electromagnet further has between the coil bobbin and the iron core a means for preventing misregistration of the coil bobbin fitted onto the iron core.

12 Claims, 11 Drawing Sheets

(Prior Arft)

ELECTROMAGNET FOR USE IN A RELAY

TECHNICAL FIELD

The present invention relates to an electromagnet for use in a relay for use as a structural member of an electromagnetic relay, wherein a coil bobbin is externally fitted onto an iron core to be wound with a coil.

BACKGROUND ART

For manufacturing an electromagnet for use in a relay, winding operation of coil on a coil bobbin is executed such that after the coil bobbin is externally fitted onto the iron core, the end of the iron core projected out of a flange opening of the coil bobbin is held with a coil winding chuck device to be fixed considering the operation efficiency.

However, when the grasping degree of the iron core with the coil winding chuck device and the engagement degree of the coil bobbin and the iron core are not enough, there is a high possibility that the iron core is disengaged from the coil winding chuck device, the iron core and the coil bobbin are displaced, and the iron core is slipped out of the coil bobbin.

FIG. 10 is an explanatory view of a conventional coil winding operation. The reference numeral 120 is a coil bobbin having flange portions 121, 122 at both ends of a coil winding part 123 and the reference numeral 130 is an iron core comprising a head portion 131 and a body portion 132.

The coil bobbin 120 is externally fitted in such a manner that the head portion 131 of the iron core 130 and the other end 132*a* of the body portion 132 are projected out of the flange portion thereof 121, 122, respectively and a coil (not shown) is wound around the coil winding part 123 between the flange portions 121, 122. The reference numeral 124 represents an extended portion of the coil bobbin and is provided with a coil terminal 125.

Coil is wound when a rotary axis 112 connected to a grasping part 111 of the coil winding chuck device 110 is rotated under the condition of FIG. 10*b*. If the power of the grasping part 111 grasping the iron core 130 is weak, there is a possibility of disengagement of the iron core 130 out of the coil winding chuck device 110 as shown in FIG. 11*a*, FIG. 11*b*. In addition, when the coupling degree of the coil bobbin 120 and the iron core 130 is not enough, the iron core 130 and the coil bobbin 120 may be displaced or the iron core 130 may be slipped out of the coil bobbin 120.

Specifically in such a coil winding method, the object to be wound (coil bobbin, iron core) is rotated to wind coil while the end 132*a* of the iron core 130 is grasped so that there is a high possibility that the object to be wound is slipped out of the coil winding chuck device 110 by such a rotating operation.

In order solve such problems, many operational and technical attempts have been conventionally done such that the grasping power of the coil winding chuck device 110 is enlarged by a slip-proof member. However, such deficiency has not been surely prevented and specific preventive measures have been required for improving the structure of the object to be wound and the coil winding chuck device.

SUMMARY OF INVENTION

Technical Problem

The present invention is proposed in view of such problems and provides an electromagnet for use in a relay which prevents disengagement of a coil bobbin and an iron core from a coil winding chuck device, misregistration of the coil bobbin and the iron core, and slip-out of the iron core from the coil bobbin, thereby preventing deficiency during winding operation.

Solution to Problem

In order to achieve the above-mentioned objects, an electromagnet for use in a relay of the present invention has a coil bobbin with flange portions at both ends of a coil winding portion where a coil is wound and an iron core with a flange-like head portion at one end of a body portion, the coil bobbin being so fitted onto the iron core that the flange-like head portion and the other end of the body portion of the iron core respectively project out of each of openings formed at the flange portions of the coil bobbin. It is characterized in that the iron core has at the other end an engageable portion to be engaged with an engaging portion formed on a grasping part of a coil winding chuck device.

According to the electromagnet for use in a relay of the present invention, the electromagnet further has between the coil bobbin and the iron core a means for preventing misregistration of the coil bobbin fitted onto the iron core.

According to the electromagnet for use in a relay of the present invention, the means for preventing misregistration of the coil bobbin fitted onto the iron core has a projecting piece inside of the coil bobbin which is pressed against the body portion of the iron core to fix the coil bobbin.

According to the electromagnet for use in a relay of the present invention, the means for preventing misregistration of the coil bobbin fitted onto the iron core has an engaging claw and an engageable hole which are respectively formed at one and other of contacting surfaces of the iron core and the coil bobbin.

According to the electromagnet for use in a relay of the present invention, the electromagnet further has a means for preventing slip-out of the iron core where the coil bobbin is fitted.

According to the electromagnet for use in a relay of the present invention, the means for preventing slip-out of the iron core where the coil bobbin is fitted has a projecting portion formed on the outer circumference of the other end of the body portion of the iron core, which hooks on the flange portion of the coil bobbin.

Advantageous Effects of Invention

According to the electromagnet for use in a relay of the present invention, the other end (open end) of the body portion of the iron core projected out of the opening of the flange portion of the coil bobbin when the coil bobbin is externally fitted onto the iron core is provided with a portion to be engaged corresponding to the engaging portion formed on the grasping part side of the coil winding chuck device, so that when the other end of the iron core is grasped with the chuck device and coil is wound, the engagement structure supplements grasping of the chuck device and the iron core is prevented from being slipped out of the chuck device.

Further according to the electromagnet for use in a relay of the present invention in which the misregistration prevention means is further provided, misregistration of the coil bobbin and the iron core which may be caused during coil winding operation can be prevented.

Specifically, according to the electromagnet for use in a relay of the present invention in which the projected piece formed on the coil bobbin side is pressed against the body portion of the iron core to fix the coil bobbin and the iron core, misregistration can be prevented with a simple structure. In addition, the iron core is not required to be processed, so that the process operation is facilitated.

According to the present invention in which the iron core and the coil bobbin are engaged and fixed with the engaging claw formed on one of the contacting surfaces and the engageable hole formed on the other surface, when they are once engaged, they can be fixed without misregistration.

According to the present invention in which the slip-out prevention means is further provided, slipping-out of the iron core from the coil bobbin, which is easily occurred, can be prevented.

According to the present invention in which the projection formed at the outer circumference of the other end of the body of the iron core is designed to be engaged to the flange portion of the coil bobbin, when they are once coupled, its coupling force is strong and there is no fear of slip-out of the iron core from the opening of the coil bobbin.

BRIEF DESCRIPTION OF DRAWINGS

FIG. 2 is an explanatory view of an electromagnet for use in a relay with a slip-out prevention means.

FIG. 1*b* is a vertical sectional view after the iron core is fitted.

FIG. 1*a* is a front view showing when the coil bobbin is being attached on the iron core, and FIG. 1*b* is a front view when the attachment is completed.

FIG. 6 is an explanatory view showing the assembly structure of the coil bobbin and the iron core of an electromagnet for use in a relay of the present invention.

DESCRIPTION OF EMBODIMENTS

The embodiment of the present invention is explained referring to the attached drawings.

FIG. 6 and FIG. 7 are explanatory views of each member of electromagnet for use in a relay of several kinds of embodiments of the present invention to be explained later. At first the diagrammatic structure of the electromagnet for use in a relay is explained referring to these figures. The structural characteristics of each embodiment, mentioned later, are not shown in these figures.

Figure 6A:
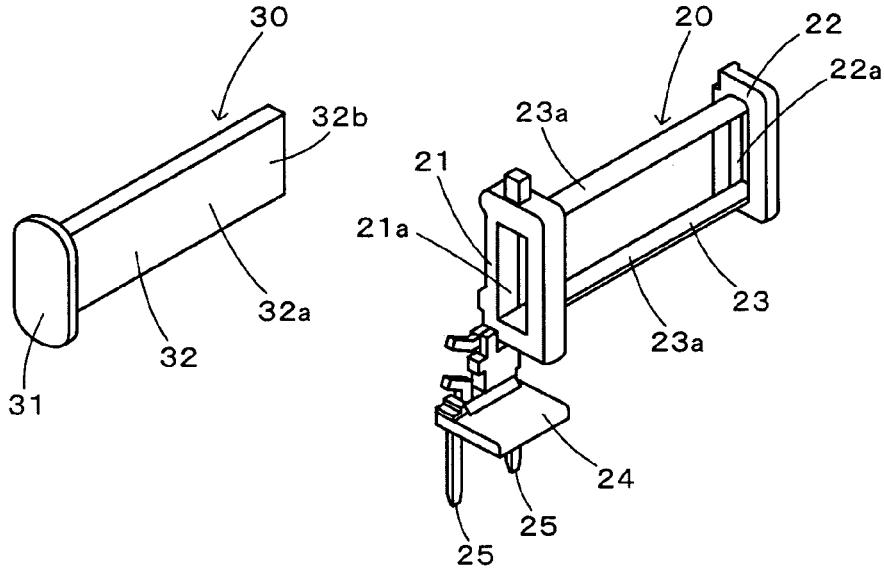
FIG. 6*a* is a perspective view of the unengaged condition.
Figure 6B:
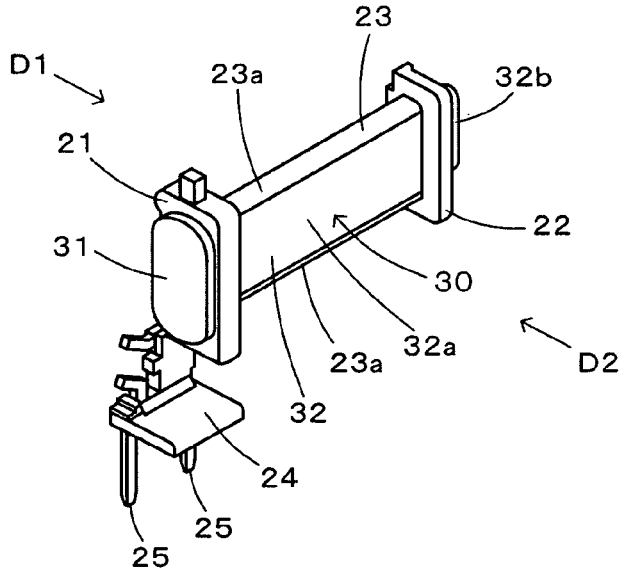
FIG. 6*b* is a perspective view of the engaged condition.

FIG. 6 is an explanatory view showing the structure of the coil bobbin and the iron core which are structural members of an electromagnet for use in a relay, FIG. 6*a* is a perspective view of the unengaged condition, and FIG. 6*b* is a perspective view of the engaged condition.

A coil bobbin 20 constituting an electromagnet for use in a relay 1 (see FIG. 7) is made of resin and is provided with a coil winding part 23 to be wound with coil 40 (see FIG. 7) and the first and the second flange portions 21, 22 at both sides of the winding part 23. The winding part 23 comprises a pair of opposing plates 23*a*, 23*a*, these plates connect both flange portions 21, 22, and openings 21*a*, 22*a* are formed at flange portions 21, 22 respectively so as to communicate the space formed between the opposing plates 23*a*, 23*a* to outside of the flange portions 21, 22 (see FIG. 6*a*).

The coil bobbin 20 is provided with an extended portion 24 extended from the first flange portion 21 and a pair of coil terminals 25 are extended to be connected to the coil 40 from the extended portion 24 (see FIG. 6*a*).

On the other hand, the iron core 30 constituting the electromagnet for use in a relay 1 is made of a magnetic material and comprises a plate-like body portion 32 and an oval flange-like head portion 31 connected at one end thereof (see FIG. 6*a*).

The iron core 30 is inserted from the opening 21*a* of the flange portion 21 of the coil bobbin 20, and the iron core 30 and the coil bobbin 20 are fittingly joined. Under such joined condition, the body portion 32 of the iron core 30 is contained in the space formed between the pair of opposing plates 21, 22 of the coil bobbin 20, the head portion 31 of the core iron 30 projects out of the opening 21*a* of the first flange portion 21, and an open end 32*b* of the body portion 32 projects out of the opening 22*a* of the second flange portion 22 (see FIG. 6*b*). Both side surfaces 32*a* of the body portion 32 of the iron core 30 are exposed on the coil winding part 23 (see FIG. 6*b*).

The coil winding part 23 of the coil bobbin 20 is designed to expose the both surfaces 32*a* of the body portion 32 of the iron core 30 in order to make the relay thinner, however, one of or both of the surfaces 32*a* of the body portion 32 may be covered with a bridging plate connecting both opposing plates 23*a*, 23*a*. The coil winding part can be reinforced by the bridging plate and damage during several operations can be prevented.

Figure 7A:
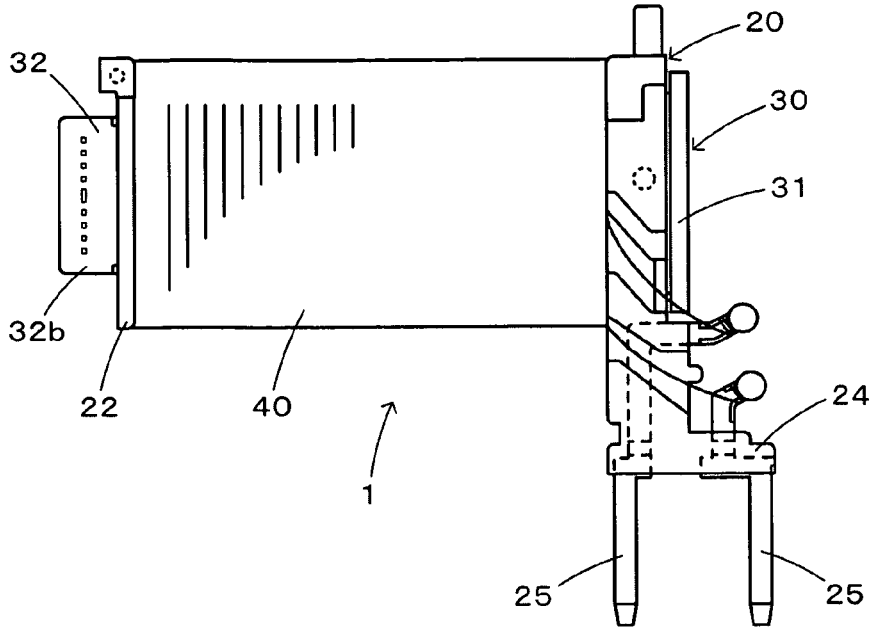
FIG. 7*a* is a front view seen from the arrow D1 in FIG. 6*b*.
Figure 7B:
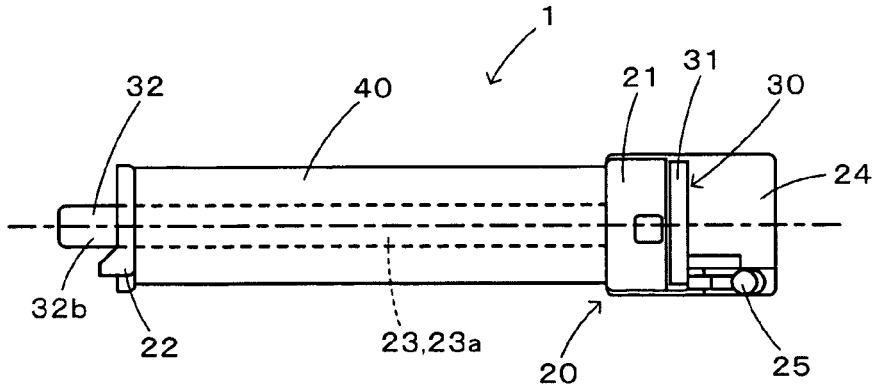
FIG. 7*b* is a plan view.

FIG. 7 shows the completed condition of the electromagnet for use in a relay 1, FIG. 7*a* is a front view seen from the arrow D1 in FIG. 6*b*, and FIG. 7*b* is a plan view.

The electromagnet for use in a relay 1 is constituted as shown in FIG. 6*b* such that the coil 40 is wound around the coil winding part 23 of the coil bobbin 20 while the coil bobbin 20 is externally coupled onto the iron core 30. The both ends of the wound coil 40 are connected to each of a pair of coil terminals 25, 25.

The coil 40 is wound when the coil bobbin 20 and the iron core 30 are integrated (see FIG. 6*b*) and the other end (open end) 32*b* of the iron core 30 is grasped with the coil winding chuck device 10 (see FIG. 1). How it is grasped with the chuck device 10 is explained later referring to FIG. 1.

According to the electromagnet 1 of the present invention, in order to prevent that (1) the open end 32*b* of the body portion 32 of the iron core 30 is unengaged from the coil winding chuck device 10, (2) the coil bobbin 30 and the iron core 30 are displaced, and (3) the iron core 30 is slipped out of the coil bobbin 20 when the coil 40 is wound, a disengagement prevention means of chuck device corresponding to (1), a means for preventing misregistration corresponding to (2) and a slip-out prevention means corresponding to (3) are provided. These prevention means are structural means formed by processing one or both of the coil bobbin and the iron core.

Views of each embodiment shown in FIG. 1 to FIG. 5 explain each prevention means and show the condition before the coil 40 is wound. In FIG. 2 to FIG. 5 the extended portion 24 and the coil terminal 25 of the coil bobbin 20 are not shown. The front view is seen from the arrow D2 in FIG. 6*b*.

Figure 1A:
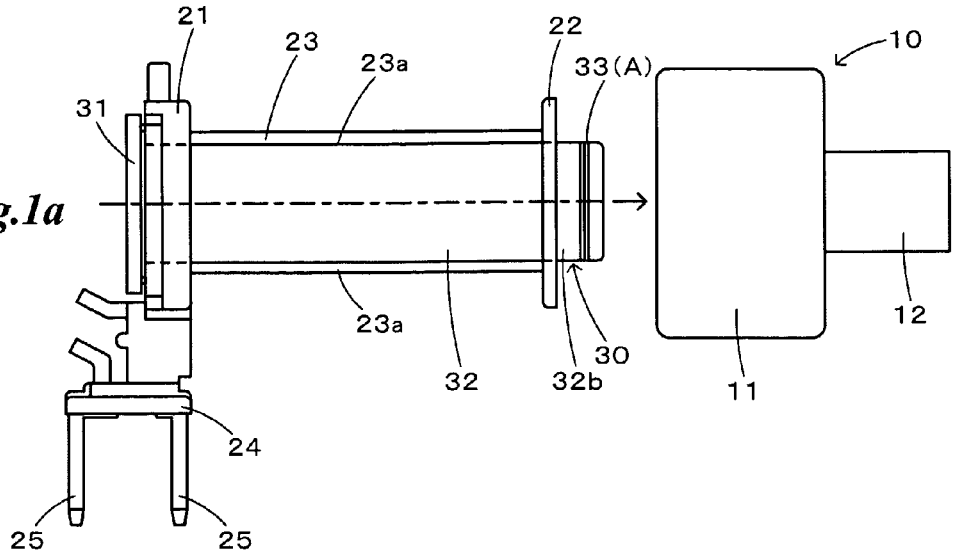
FIG. 1*a* is a front view showing the structure of an electromagnet for use in a relay with a disengagement prevention means of the present invention.
Figure 1B:
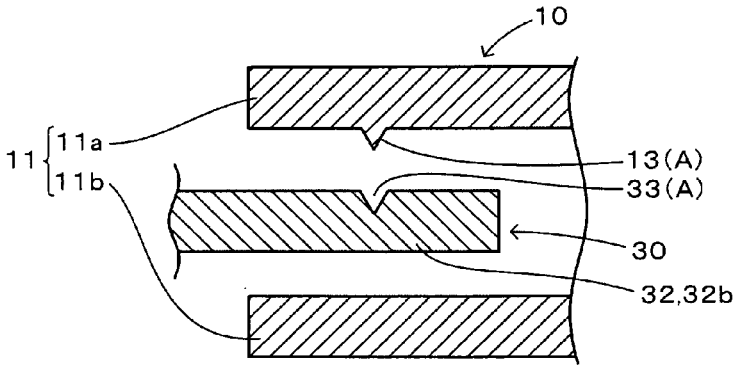
FIG. 1*b* and FIG. 1*c* are explanatory views showing the grasping structure of an iron core with a coil winding chuck device.
Figure 1C:
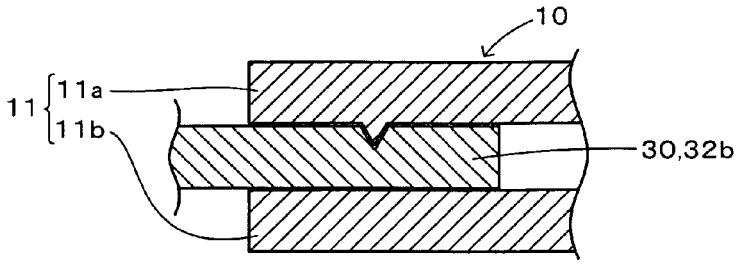

FIG. 1*a* is a front view showing the structure of the electromagnet for use in a relay 1 with a disengagement prevention means A of chuck device, and FIG. 1*b* and FIG. 1*c* show partially longitudinal section showing the grasping structure of the iron core 30 with the coil winding chuck device 10.

Coil is wound while the open end 32*b* of the body portion 32 of the iron core 30 projected out of the second flange portion 22 of the coil bobbin 20 is grasped with opposing grasping pieces 11*a*, 11*b* of the grasping part 11 of the coil winding chuck device so as not to displace the central axis of the iron core 30 and then a rotary operating portion 12 is rotated around the iron core 30 as a center axis.

The chuck disengagement prevention means A is provided so as not to disengage the iron core 30 from the chuck device 10 during such rotating operation and is constituted with a portion to be engaged (namely an engageable portion) provided on the iron core 30 side and the engaging portion provided for the grasping part 11 of the coil winding chuck device 10.

In this embodiment, the portion to be engaged on the iron core 30 side is constituted with a groove portion 33 running in the lateral direction of the iron core 30 formed on one side surface 32*a* of the open end 32*b* of the iron core 30 projected out of the second flange portion 22 of the coil bobbin 20. On the other hand, the engaging portion of the coil winding chuck device 10 is constituted with a projecting piece 13 formed inside of one of the grasping piece 11*a* of the grasping part 11 (see FIG. 1*b*).

When the end 32*b* of the iron core 30 is aligned between the opposing grasping pieces 11*a*, 11*b* of the coil winding chuck device 10 to be grasped therebetween as shown in FIG. 1*b* and FIG. 1*c*, and the projecting piece 13 provided for the grasping part 11 is fitted in the groove portion 33 to be engaged with one another (see FIG. 1*b* and FIG. 1*c*).

The iron core 30 is engaged with the engaging portion (projecting piece 13) when being grasped, so that the grasping condition of the end 32*b* of the iron core 30 can be firmly kept without misregistration and the iron core 30 and the coil bobbin 20 are positionally fixed in a rotatable manner.

FIG. 1 shows the structure in which the portion to be engaged (groove 33) is provided on one of the side surfaces 32*a* of the iron core 30, however, the groove 33 may be provided at both surfaces 32*a* of the iron core 30, a projecting piece 13 may be correspondingly provided for both grasping pieces 11*a*, 11*b* of the coil winding chuck device 10 and grasping may be more firmly supplemented. Contrary to the structure in FIG. 1, the engaging portion may be constituted with a groove portion and the portion to be engaged may be constituted with the projecting piece.

Further, the chuck disengagement prevention means A may be designed such that a plurality of projecting pieces (engaging portion) may be mounted to a plurality of engaging holes (portion to be engaged) or both ends in the lateral direction of the iron core 30 may be formed with cutout and an engaging projection may be engaged in the cutout.

In addition, a plurality of parallel grooves 33 may be formed at the end 32*b* of the iron core 30. When a plurality of grooves 33 are provided, positional arrangement for engagement is facilitated and the iron core 30 can be rapidly grasped with the coil winding chuck device 10. Further, the portion to be engaged of the iron core 30 may be formed with a minute concavo-concave like a nonslip member, wherein the coil winding chuck device 10 having an engaging portion constituted with a concavo-convex structure instead of the projecting piece can achieve the above-mentioned effect.

As mentioned above, the electromagnet for use in a relay 1 has an engagement structure such that the portion to be engaged (groove 33) of the iron core 30 is engaged with the engaging portion (projecting piece 13) of the coil winding chuck device 10, so that the grasping of the coil winding chuck device 10 can be supplemented by the engaging structure and the chuck device 10 and the iron core 30 are hardly displaced. As the result, the end 32*b* of the iron core 30 projected out of the flange portion 22 of the coil bobbin 20 is prevented from disengaging from the grasping part 11 of the coil winding chuck device 10.

The coil winding chuck device 10 may not be rotatably fixed with a rotary axis, and the coil 40 may be rotated to be wound while fixing the iron core 30 and the coil bobbin 20.

Figure 2A:
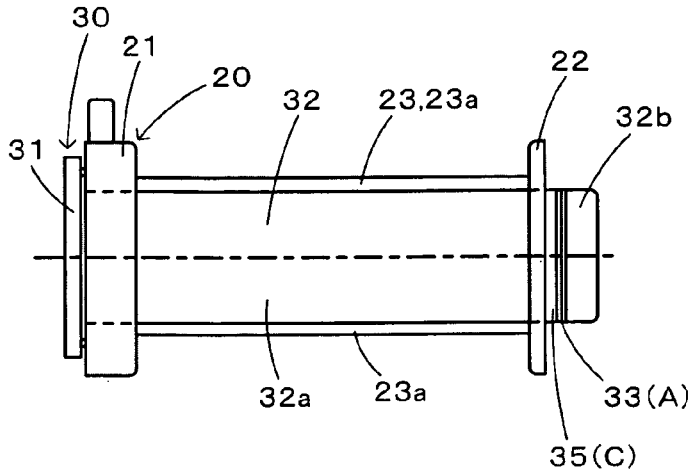
FIG. 2*a* is its front view.
Figure 2B:
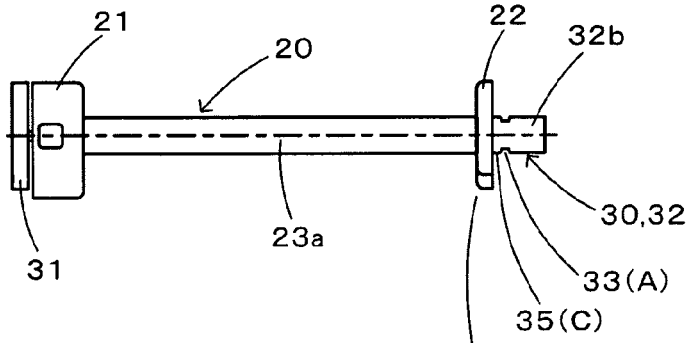
FIG. 2*b* is its plan view and FIG. 2*c* is a right side view.
Figure 2C:
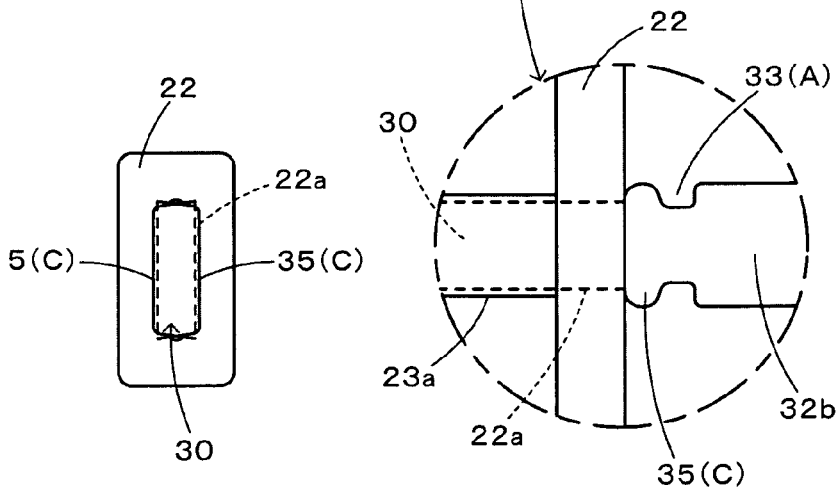

FIG. 2 shows another embodiment and is an explanatory view of an electromagnet for use in a relay with a slip-out prevention means C, FIG. 2*a* is its front view, FIG. 2*b* is its plan view (including partially enlarged view) and FIG. 2*c* is a right side view.

In this embodiment, the iron core 30 is provided with the portion to be engaged (groove portion 33) to be engaged at the engaging portion of the coil winding chuck device 10 at both side surfaces 32*a*, and the groove portion 33 is pressed after the iron core 30 is mounted on the coil bobbin 20.

Namely, the groove portion 33 is formed such that the surface of the end 32*b* is pressed with punching while the end 32*b* of the iron core 30 is projected out of the opening 22*a* of the second flange portion 22. The adjacent portion of the groove portion 33 is formed with the projecting portion 35 so as to come into contact with the second flange portion 22 of the coil bobbin 20. The projecting portion 35 is formed by pressing the groove portion 33. The groove portion 33 and the projecting portion 35 may be formed all around the iron core 30.

When the projecting portion 35 is formed on both side surfaces 32*a* of the iron core 30, the thickness of the iron core where the projecting portion 35 is formed becomes larger than the width of the opening 22*a*, so that the iron core 30 is positionally fixed and does not slip out.

The iron core 30 of the electromagnet for use in a relay 1 is thus provided with the chuck disengagement prevention means A (portion to be engaged, groove portion 33) and the slip-out prevention means C (projecting portion 35), so that such deficiency that the object to be wound is disengaged from the chuck device 10 and the iron core 30 is slipped out of the coil bobbin 20 during coil winding operation is hardly happened, thereby enabling efficient operation. Further, the projecting portion 35 is formed at the same time of process of the groove portion 33, thereby achieving chuck disengagement prevention and the slip-out with a simple method.

Figure 3A:
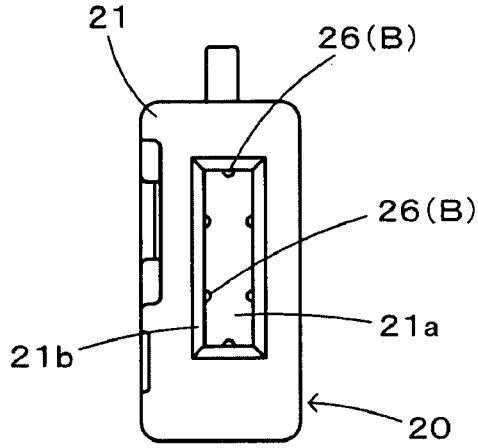
FIG. 3*a* shows a coil bobbin seen from the first flange portion.
Figure 3B:
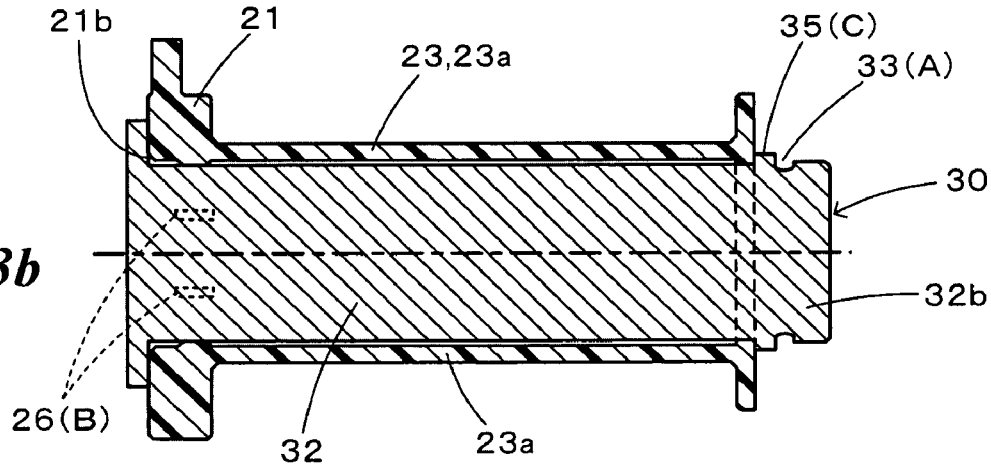
FIG. 3 is, an explanatory view of an electromagnet for use in a relay with a means for preventing misregistration of the present invention.

FIG. 3 is an explanatory view of an electromagnet for use in a relay with a means for preventing misregistration B, FIG. 3*a* shows a coil bobbin 20 seen from the first flange portion 21, and FIG. 3*b* is a vertical sectional view after mounting the iron core 30.

In this embodiment, the coil bobbin 20 has one or a plurality of projecting pieces 26 on the inner circumference of the opening 21*a* of the first flange portion 21 and the projecting pieces 26 come into contact under pressure with the body portion 32 of the internally fitted iron core 30. The portion of the opening 21*a* of the first flange portion 21 which comes into contact with the head portion 31 of the iron core 30 (inserting port of the iron core 30) has a tapered guided portion 21*b* for facilitating insertion of the iron core 30 and the projecting piece 26 is preferably provided on the inserting direction side rather than the guide portion 21*b* side.

The projecting piece 26 of the coil bobbin 20 is thus designed to be pressed against the iron core 30, so that the coil bobbin 20 and the iron core 30 are once coupled, they do not cause positional displacement and the iron core 30 is hardly displaced during winding operation of coil.

In the figure, the iron core 30 is provided with the groove portion 33 for preventing chuck disengagement and the projecting portion 35 for preventing slip-out, and any deficiency is hardly caused during coil winding operation because of each prevention means. In the embodiment of FIG. 3, the groove portion 33 and the projecting portion 35 are formed all around the iron core 30. The projecting portion 35 of the iron core 30 for preventing slip-out and the projecting piece 26 of the coil bobbin 20 for preventing positional displacement have cooperative relation and they can be supplemented with each other when one of them is not adequately worked, therefore, both of them are preferably formed.

Figure 4A:
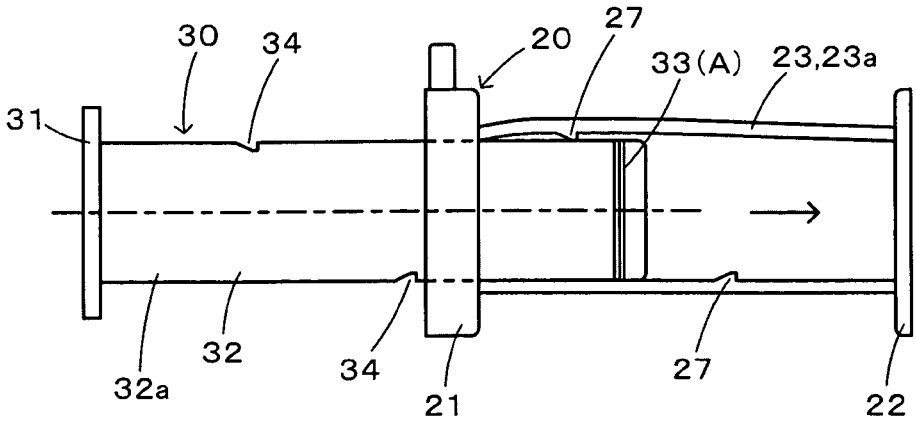
FIG. 4 is an explanatory view showing another embodiment of a means for preventing misregistration.
Figure 4B:
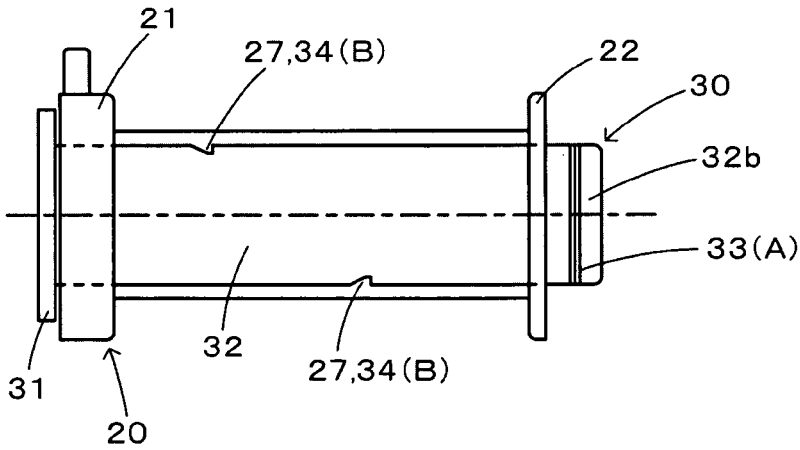

FIG. 4 is an explanatory view of another embodiment of the misregistration prevention means B, FIG. 4*a* is a front view showing when the coil bobbin 20 is being inserted on the iron core 30, and FIG. 4*b* is a front view when the attachment is completed.

In this embodiment, an engaging claw 27 is formed on the contacting surface of the opposing pieces 23*a* constituting the coil winding part 23 of the coil bobbin 20 with the iron core 30, an engageable hole 34 to be engaged with the engaging claw 27 is formed at the upper and lower ends of the body portion 32 of the iron core 30, and the engaging claw 27 and the engageable hole 34 constitute the misregistration prevention means B.

When the iron core 30 is inserted into the coil bobbin 20, the engaging claw 27 comes into contact with the iron core 30 under pressure, so that the opposing pieces 23*a* of the coil bobbin 30 are temporally elastically deformed. However, when the iron core 30 is completely fitted in, the engaging claw 27 is inserted in the engageable hole 34 to be engaged. When the iron core 30 is mounted, the body portion 32 of the iron core 30 and the coil winding part 23 are firmly attached without any gap by such a mutual engagement.

The portion of the engaging claw 27 to which the iron core 30 is inserted is inclined, so that the iron core 30 is easily fitted, however, the engaging claw 27 and the engageable hole 34 are once engaged when the iron core 30 is inserted, the engagement is not released even if the iron core 30 is moved into the extracting direction, and the positional displacement of the coil bobbin 20 and the iron core 30 cannot be caused during coil winding operation thereafter.

The portion to be engaged (groove portion 33) for grasping with the chuck device 10 formed at the end 32*b* of the iron core 30 may be also provided with the projecting par 35 for preventing slip-out of the iron core 30 as shown in FIG. 3.

Figure 5:
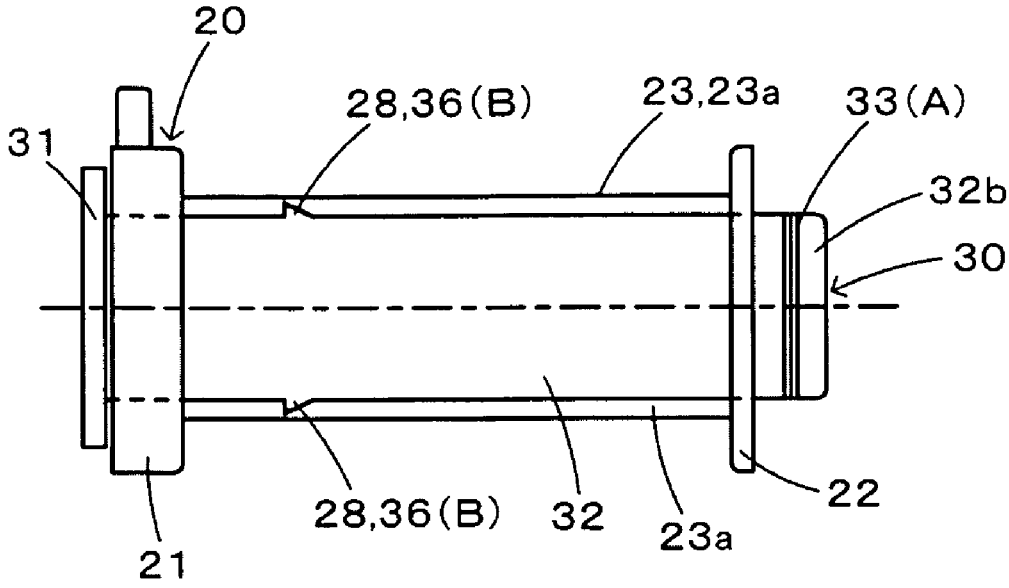
FIG. 5 is a front view showing another embodiment of a means for preventing misregistration.

FIG. 5 shows another embodiment wherein the iron core 30 has an engaging claw 36 and the coil bobbin 20 has an engageable hole 28 in contrast to the structure of FIG. 4 and the engaging claw 36 and the engageable hole 28 constitute the misregistration prevention means B. The attachment of the coil bobbin 20 to the iron core 30 and the engagement principle of the engaging claw 36 and the engageable hole 28 are same as those in FIG. 4 and their explanations are omitted.

In the embodiments in FIG. 2 to FIG. 5, the misregistration prevention means B and the slip-out prevention means C are explained assuming the prevention means for chuck disengagement A is provided, however, the prevention means of chuck disengagement A may not be provided. Namely, the misregistration prevention means B and the slip-out prevention means C are not limited to the purpose of preventing misregistration and slip-out during winding operation of coil and one or combination of the means may be provided for preventing them in other operations.

Next, an electromagnetic relay produced with thus formed electromagnet for use in a relay 1 is explained.

Figure 8:
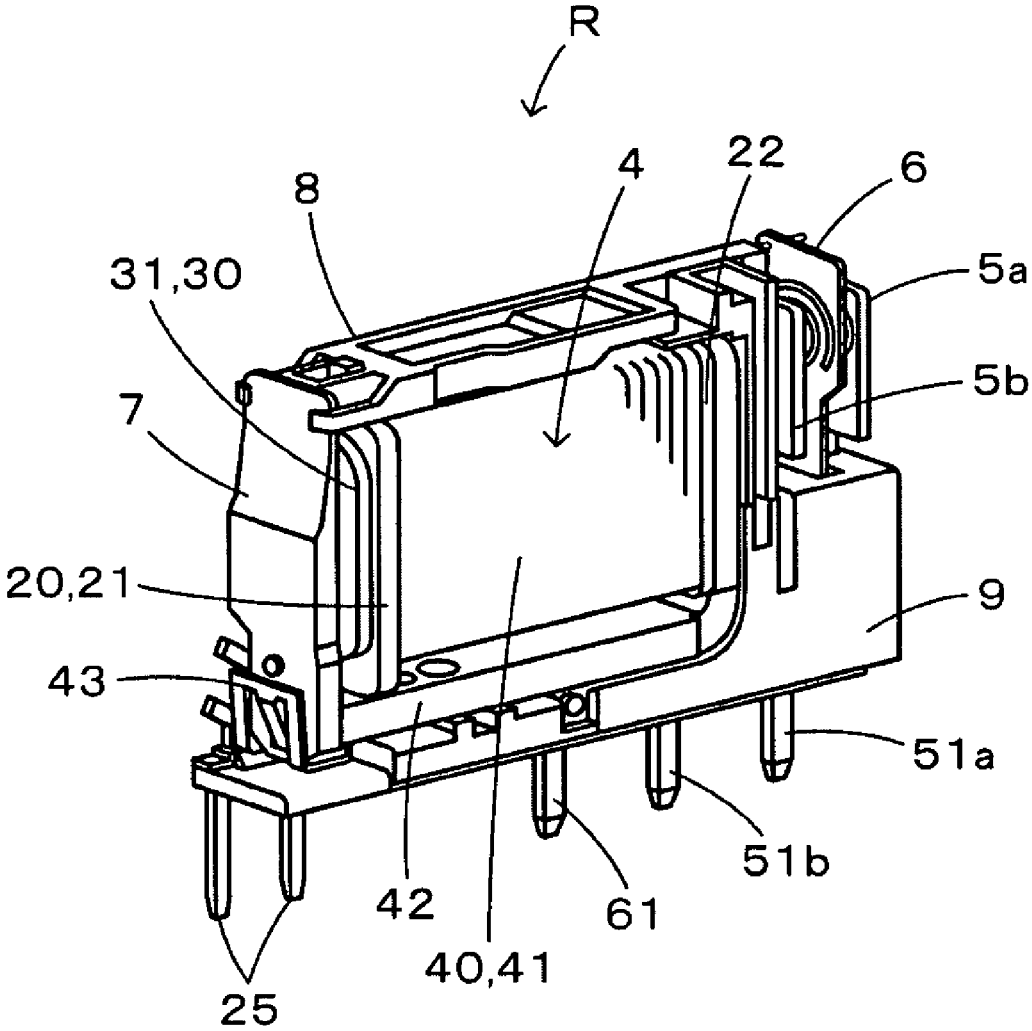
FIG. 8 is a perspective view of an electromagnetic relay using the electromagnet for use in a relay of the present invention.
Figure 9:
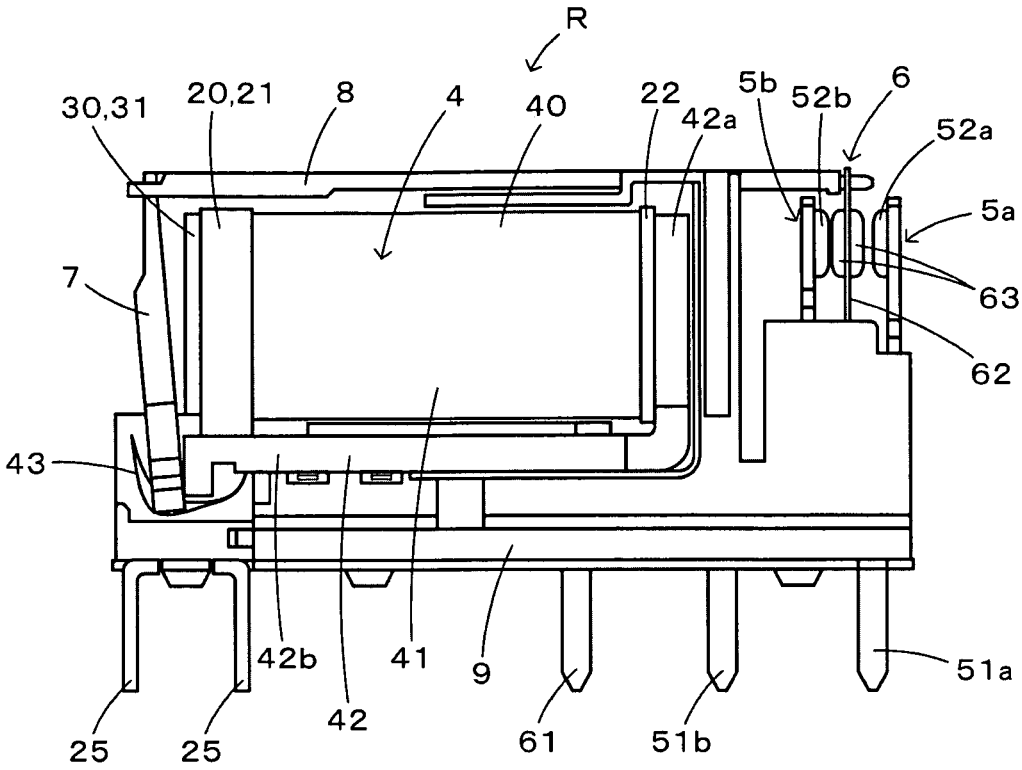
FIG. 9 is a front view of the above-mentioned electromagnetic relay.
Figure 10A:
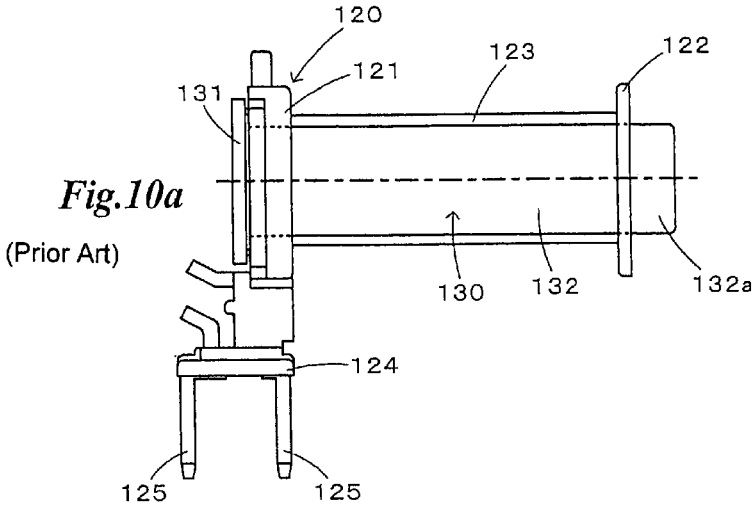
Fig.10a (Prior Art)
FIG. 10 is an explanatory view of conventional coil winding.
Figure 10B:
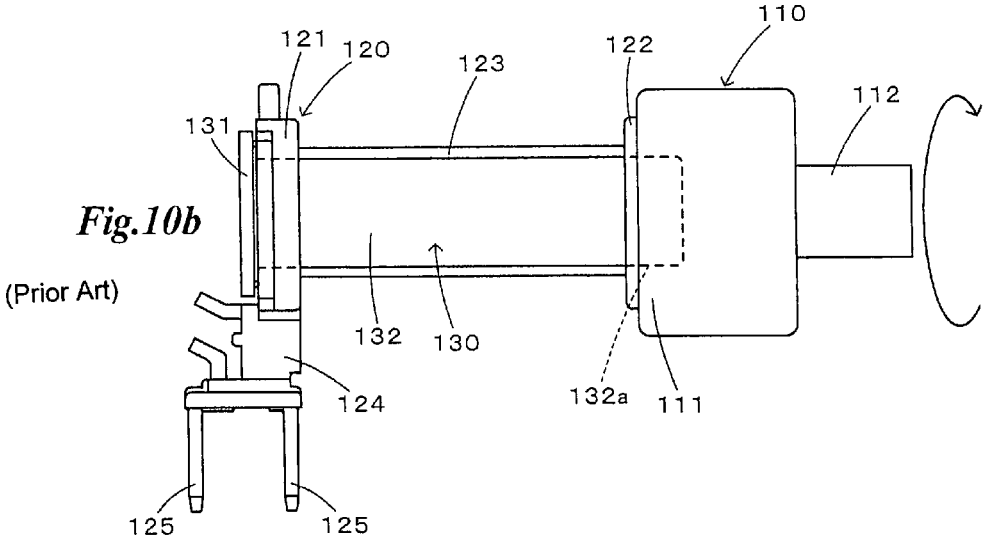
Fig.10b (Prior Art)
Figure 11A:
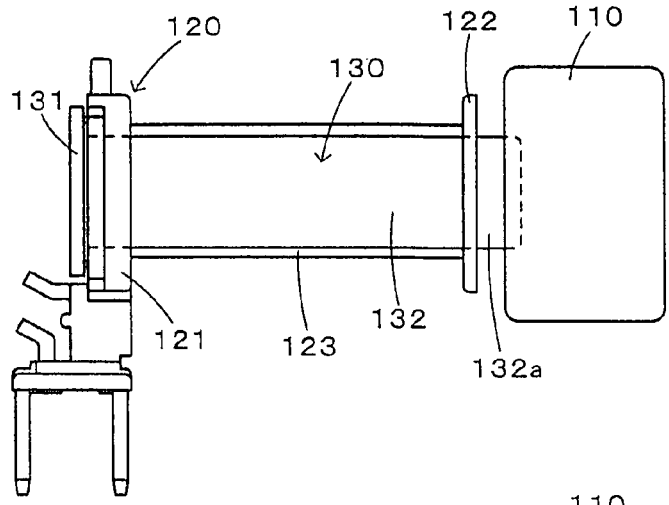
Fig.11a (Prior Art)
FIG. 11*a* to FIG. 11*c* are front views showing the deficiency of conventional coil winding.
Figure 11B:
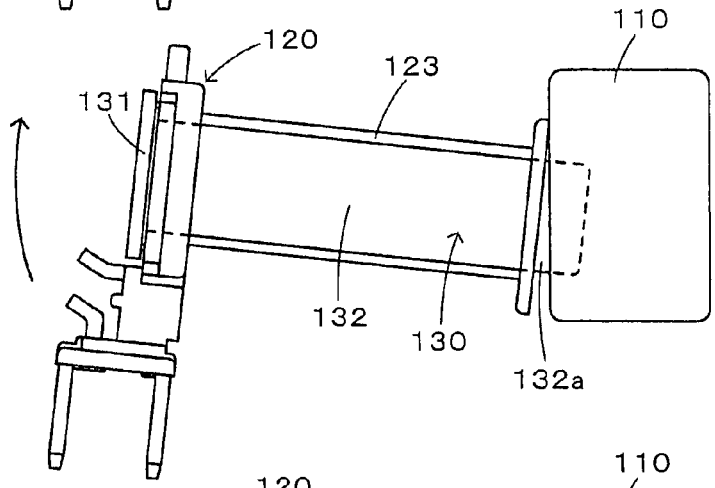
Fig.11b (Prior Art)
Figure 11C:
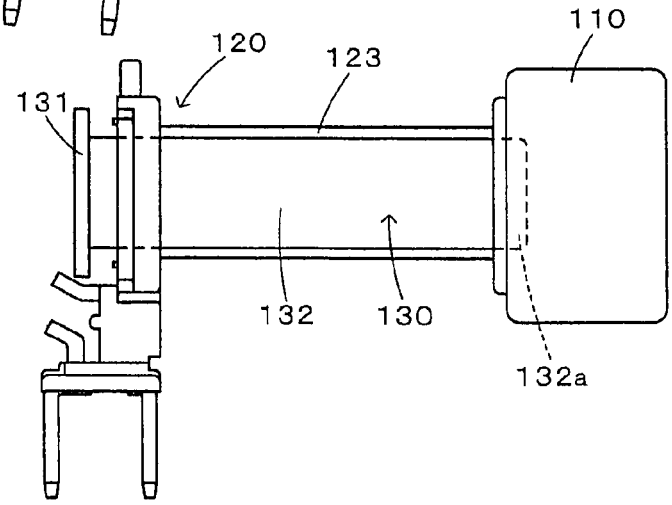

FIG. 8 and FIG. 9 are a perspective view and a front view showing one example of the electromagnetic relay. An electromagnetic relay R mentioned as below has each prevention means A, B, C for each member of the electromagnet for use in a relay 1 as mentioned above. However, the structure of each prevention means A, B, C is not shown in the figures.

The above-mentioned electromagnet for use in a relay 1 is used for the electromagnetic relay R, and a base 9 made of resin is provided with an electromagnet block 4 mounting the electromagnet for use in a relay 1, a fixed contact block 5*a* (at right in the figure), another fixed contact block 5*b* (at left in the figure), a moving contact spring block 6 interposed between the fixed contact blocks 5*a*, 5*b*, an armature 7, and a card 8. A resin cover (not shown) is provided thereon.

One fixed contact block 5*a* is constituted with a metal fixed terminal 51*a* and a metal fixed contact 52*a* provided above the fixed terminal 51*a*. In the same manner, the other fixed contact block 5*b* is constituted with a metal fixed terminal 51*b* and a metal fixed contact 52*b* provided above the fixed terminal 51*b*.

The moving contact spring block 6 is constituted with a metal moving terminal 61, a metal flat spring 62 of which lower end (not shown) is connected to the upper end (not shown) of the moving terminal 61, and a pair of metal moving contacts 63, 63 provided on both surfaces of the flat spring 62. The flat spring 62 is provided between the above-mentioned two fixed contacts 52*a*, 52*b* and is incorporated into the base 9 in such a manner that the pair of moving contacts 63, 63 removably oppose the fixed contacts 52*a*, 52*b*, respectively.

The electromagnet block 4 comprises the electromagnet for use in a relay 1 wound with the coil 40, a yoke 42, and a hinge spring 43 for attaching the armature and is assembled to the base 9.

The yoke 42 is formed like a letter "L" and a fixing portion 42*a* formed at its one end is connected to the open end 32*b* of the body portion 32 projected into the second flange portion 22 of the coil bobbin 20 (see FIG. 1 to FIG. 7) and is provided so as to be substantially parallel to the coil winding part 23 of the coil bobbin 20. The other end 42 of the yoke 42 is fasted with the hinge spring 43.

The lower end of the armature 7 is turnably supported to the 42 via the hinge spring 43 and the armature 7 is turned by magnetic attractive force of the head portion 31 of the iron core 30 to stick therewith. When the head portion 31 of the iron core 30 loses the magnetism, the armature 7 is turned in a direction apart from the head portion 31 by the action of the hinge spring 43.

The card 8 is a working piece engaged into both of the moving contact spring block 6 and the armature 7 and makes one of the moving contacts 63 of the moving contact spring block 6 come into contact with either one of the fixed contacts 52*a*, 52*b* of the fixed contact block 5*a*, 5*b* according to turning of the armature 7.

According to the electromagnetic relay R, the card 8 connects the armature 7 and the moving contact spring block 6 capable of interlocking and the moving contacts 63, 63 can contact with or separate from two fixed contacts 52*a*, 52*b* by the contact/separation operation of the armature 7 to/from a magnetic pole surface 31*b* of the iron core 30.

The invention claimed is:

1. An electromagnet for use in a relay having a coil bobbin with flange portions at both ends of a coil winding portion where a coil is wound and an iron core with a flange-like head portion at one end of a body portion, the coil bobbin being so fitted onto the iron core that the flange-like head portion and the other end of the body portion of the iron core respectively project out of each of openings formed at the flange portions of the coil bobbin, wherein said iron core has at said other end an engageable portion to be engaged with an engaging portion formed on a grasping part of a coil winding chuck device; and said flange portions at both ends of said coil winding portion are coupled with a pair of opposing plates.

2. The electromagnet for use in a relay as set forth in claim 1, wherein said electromagnet further has between said coil bobbin and said iron core a means for preventing misregistration of said coil bobbin fitted onto said iron core.

3. The electromagnet for use in a relay as set forth in claim 2, wherein said means for preventing misregistration of said coil bobbin fitted onto said iron core has a projecting piece inside of said coil bobbin which is pressed against said body portion of said iron core to fix said coil bobbin.

4. The electromagnet for use in a relay as set forth in claim 2, wherein said means for preventing misregistration of said coil bobbin fitted onto said iron core has an engaging claw and an engageable hole which are respectively formed at one and other of contacting surfaces of said iron core and said coil bobbin.

5. The electromagnet for use in a relay as set forth in claim 1, wherein said electromagnet further has a means for preventing slip-out of said iron core where said coil bobbin is fitted.

6. The electromagnet for use in a relay as set forth in claim 5, wherein said means for preventing slip-out of said iron core where said coil bobbin is fitted has a projecting portion formed on the outer circumference of the other end of said body portion of said iron core, which hooks on said flange portion of said coil bobbin.

7. The electromagnet for use in a relay as set forth in claim 2 wherein said electromagnet further has a means for preventing slip-out of said iron core where said coil bobbin is fitted.

8. The electromagnet for use in a relay as set forth in claim 3 wherein said electromagnet further has a means for preventing slip-out of said iron core where said coil bobbin is fitted.

9. The electromagnet for use in a relay as set forth in claim 4 wherein said electromagnet further has a means for preventing slip-out of said iron core where said coil bobbin is fitted.

10. The electromagnet for use in a relay as set forth in claim 7, wherein said means for preventing slip-out of said iron core where said coil bobbin is fitted has a projecting portion formed on the outer circumference of the other end of said body portion of said iron core, which hooks on said flange portion of said coil bobbin.

11. The electromagnet for use in a relay as set forth in claim 8, wherein said means for preventing slip-out of said iron core where said coil bobbin is fitted has a projecting portion formed on the outer circumference of the other end of said body portion of said iron core, which hooks on said flange portion of said coil bobbin.

12. The electromagnet for use in a relay as set forth in claim 9, wherein said means for preventing slip-out of said iron core where said coil bobbin is fitted has a projecting portion formed on the outer circumference of the other end of said body portion of said iron core, which hooks on said flange portion of said coil bobbin.

* * * * *